US007011587B2

(12) United States Patent
James

(10) Patent No.: US 7,011,587 B2
(45) Date of Patent: Mar. 14, 2006

(54) INFLATABLE FIELD ENCLOSURE DIVIDER

(76) Inventor: Damian Anthony James, 659 NE. 60th St., Miami, FL (US) 33137

( * ) Notice: Subject to any disclaimer, the term of this patent is extended or adjusted under 35 U.S.C. 154(b) by 93 days.

(21) Appl. No.: 10/443,994

(22) Filed: May 22, 2003

(65) Prior Publication Data

US 2004/0106479 A1 Jun. 3, 2004

Related U.S. Application Data

(60) Provisional application No. 60/429,934, filed on Nov. 29, 2002.

(51) Int. Cl.

| | |
|---|---|
| ***A63B 67/00*** | (2006.01) |
| ***A63B 61/00*** | (2006.01) |
| ***A63C 19/00*** | (2006.01) |

(52) U.S. Cl. ..... 473/415; 473/490; 473/92; 473/134

(58) Field of Classification Search ..... 473/422, 473/415, 490; 472/92, 94, 134; 62/235; 52/2.23, 52/2.24; 482/23, 27

See application file for complete search history.

(56) References Cited

U.S. PATENT DOCUMENTS

| | | | | |
|---|---|---|---|---|
| 3,801,093 A | | 4/1974 | Jones, III | |
| 3,808,831 A | | 5/1974 | Landry | |
| 4,815,301 A | | 3/1989 | Deloughery | |
| 5,462,505 A | * | 10/1995 | Blair et al. | 482/27 |
| 5,720,678 A | | 2/1998 | Korthauer | |
| 5,855,371 A | * | 1/1999 | Sanders | 472/134 |
| 5,906,373 A | * | 5/1999 | Sanders | 273/349 |
| 5,937,586 A | | 8/1999 | Scherba | |
| 6,296,580 B1 | * | 10/2001 | Hamet | 473/415 |
| 6,364,782 B1 | | 4/2002 | Ochi | |

* cited by examiner

*Primary Examiner*—Mitra Aryanpour
(74) *Attorney, Agent, or Firm*—Malin, Haley & DiMaggio, P.A.

(57) ABSTRACT

An inflatable barrier for simultaneously substantially enclosing several areas comprising an elongated, hollow barrier member formed of connected elements of flexible substantially fluid impervious material joined to form a continuous configuration of sufficient size and shape to simultaneously demark several areas on a substantially flat surface; and a connector to a source of a fluid and for conducting said fluid into the interior of said hollow barrier member to inflate it, said barrier member having at least one interior transverse element and a plurality of end elements for substantially encompassing at least one of the surrounded areas, and said continuous configuration in the inflated condition supported on said substantially flat surface substantially defining a perimeter surrounding said areas. The barrier is capable of holding signage, and includes enclosures for players in an area.

13 Claims, 4 Drawing Sheets

INFLATABLE FIELD ENCLOSURE DIVIDER

This application claims the benefit of Provisional Patent Application Ser. No. 60/429,934, filed Nov. 29, 2002.

BACKGROUND OF THE INVENTION

1. Field of the Invention

The invention related to an inflatable field enclosure. More particularly, it relates to a one-piece system that is easy to assemble and store.

2. Description of Related Art

The need for portable, lightweight, easy to inflate and operate enclosures is varied. For example, conventions or fundraisers need enclosures so different areas can be used for different purposes. However, the need for this type of enclosure for a wide open area is especially sharp in the area of sports.

Many sports are played on a generally open field of a limited size. Opposing teams on the field attempt to drive a ball or similar object into the goal of the opponent. Popular games played on such field include football, soccer, field hockey and rugby, as well as other sports.

One of the main problems associated with games played on an open field is that the ball, which is used in the game, may be driven out of the playing area. Recreational time is wasted as players or coaches seek to retrieve a ball which has escaped a marked area of play. Furthermore, children seen to retrieve a ball may not be aware of their surroundings and can wander into a dangerous area such as a parking lot or open road. Another major problem is that a ball traveling at a high rate of speed beyond the playing area may injure onlookers who may be standing or sitting around the perimeter of the playing area. Also, it takes a long period of time to inflate enclosures for several areas. To reduce the time using the present art, additional air sources would be necessary, increasing costs and making logistics difficult.

Others have attempted to construct barriers to overcome these problems. For example, U.S. Pat. No. 5,937,586 issued to Scherba describes an inflatable skating rink comprising a plurality of base modules which are distinct in construction and are interconnected only during use, so that the modules may be separated during assembly of the skating rink. Also, U.S. Pat. No. 5,720,678 issued to Korthauer is for an inflatable barrier for sports game. The hollow barrier is for a single enclosure of a field. The use of a plurality of these enclosures side-by-side would make a waste of space for a large area, where such space is at a premium. Moreover, side gates or entries into the inflatable barrier and intrinsic goal areas which would improve the aesthetics and safety of the enclosure are not taught. In addition, there is no provision for player holding areas or scoring tables in or around the area of the barrier.

The present invention solves these problems by providing a one-piece inflatable barrier for simultaneously substantially enclosing several areas that is easy to inflate, lightweight and easy to store, which also provides for the inclusion of signage.

SUMMARY OF THE INVENTION

The present invention provides a portable, lightweight inflatable barrier for simultaneously substantially enclosing several areas. The barrier comprises an elongated, hollow barrier member formed of connected elements of flexible substantially fluid impervious material joined to form a continuous configuration of sufficient size and shape to simultaneously demark several areas on a substantially flat surface. The barrier also has means, internal or external, for connecting the member with a source of a fluid and for inflation. The barrier member has at least one interior transverse element and a plurality of end elements for substantially encompassing at least one of the surrounded areas. The inflated barrier is supported on the flat surface and defines a perimeter surrounding the areas. In one embodiment, the barrier further comprises a connector on each element of said elongate hollow barrier member for releasably joining said plurality of connected elements.

The preferred material for the inflatable barrier is vinyl. The transverse element is preferably T-shaped, and the end element is preferably L-shaped. In one embodiment, a gating for at least one of the areas is located between a transverse element and a corner element. In another embodiment, gating is located at an opening between two transverse elements. The gating is preferably a mesh made of plastic.

In another embodiment of the invention, one or more means for holding players of a game on an enclosed field is releasably attached to an outer perimeter of the barrier. Such means includes one or more walls made of mesh or other materials. The walls may be attached to the outside of an end element, a transverse element, or both. In addition, a scoring table may be located at an opening between said transverse element and said comer element.

In another embodiment, the barrier has means for attaching signage on an outer surface of the barrier element, such as ties or hook-and-loop fastener, such as VELCRO. In still another embodiment, the barrier includes a specific connection element for the fluid inflating the barrier.

In yet another embodiment, goal areas are located on the lower portion of the transverse elements and/or the end elements. The goal areas preferably include netting.

The method of the instant invention for forming an inflatable barrier for simultaneously enclosing several areas comprises the steps of providing an inflatable barrier on a substantially level surface, connecting the hollow barrier member with a source of a fluid, and inflating the barrier with the fluid. The fluid is preferably air. Next, the barrier may be anchored, if desired or appropriate.

In still another embodiment, the invention is a lightweight, portable, inflatable apparatus for simultaneously substantially enclosing several areas for sports comprising flexible substantially air impervious means for forming a boundary of sufficient size and shape to simultaneously demark a plurality of areas for sports; and means for connecting said boundary with an air source and for conducting said air into the interior of said boundary member to inflate it. In another embodiment, the apparatus also has means for holding players located on the outer perimeter of the apparatus.

An improved inflatable barrier is provided with the present invention which vastly improves the efficiency for demarking areas in an open space. The barrier is especially useful in demarking areas for sports to be played.

It is an object of the invention to provide a one-piece barrier member that is easy to deploy on a field. It is another object of this invention to provide a barrier that is simple to assemble and store.

It is a further object of the invention to provide a portable enclosure that can quickly be inflated and deflated, to allow play on the enclosed areas in a short amount of time.

It is another object of this invention to provide a stadium or arena feel to a player playing a game inside it when the barrier is inflated in a wide open area.

It is another object of the invention to provide an efficient enclosure made of one piece for an open space, whether it is in a concrete area, an open field, or on a synthetic surface.

It is still another object of the invention to provide a barrier for multiple areas that is adaptable for including signage on the inside or outside of the enclosed areas.

It is yet another object of the invention to provide an apparatus to be used for marketing by using banners.

It is yet another object of the invention to provide an enclosure for multiple areas which includes at least partially enclosed player holding areas for an area, and which provides an area for a scoring table.

In accordance with these and other objects which will become apparent hereinafter, the instant invention will now be described with particular reference to the accompanying drawings.

DETAILED DESCRIPTION

Figure 1:
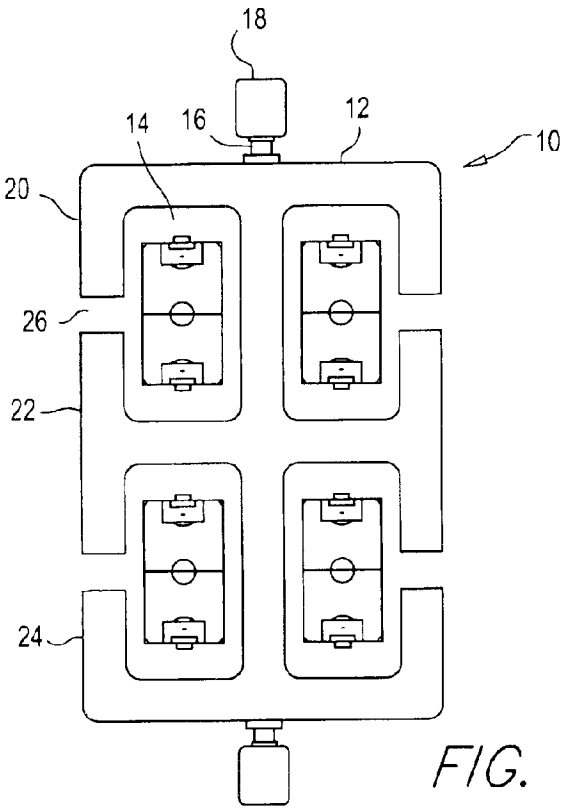
FIG. 1 shows a top plan view of the preferred embodiment of the invention.

With respect to the drawings, FIGS. 1–6 depict an inflatable barrier generally indicated by the reference numeral 10. Referring now to FIG. 1, the inflatable barrier 10 of the present invention is shown. The barrier 10 generally comprises an elongated, hollow barrier member 12 formed of connected tubular elements. The elements are hollow and preferably constructed out of flexible substantially fluid impervious material. Preferred materials include vinyl or other air impermeable material, soft plastic, or any other material that can be inflated by a fluid. The term fluid is used herein to include both gasses, such as air, and liquids, such as water. The elements may be joined by glue, paste thread or other binding material that will still enable the member 12 to be put in an inflated state. Alternatively, the member 12 may be formed as a single piece. The member 12 forms a continuous configuration of sufficient size and shape to simultaneously demark several areas 14 for purposes such as sports, outdoor meetings and fundraisers. The barrier has the ability to enclose both large and small areas such as fields.

It is preferred that the barrier 10 is placed on a substantially flat surface; however, the surface does not need to be perfectly level. The barrier is useful for areas such as open fields, large indoor areas such as convention halls or outdoor areas having a synthetic covering like a stadium. The height of the barrier depends upon the user. It may be sufficiently high so that adjacent areas 14 or the outside of the barrier cannot be seen over them. However, for events such as junior league games, it may be desired that the barrier height is low, so that a supervisor can see into the areas 14. It may also be desired to anchor the element 12 to keep the wind or internal air flow from moving it. The barrier element 12 can be anchored to the ground surrounding the barrier 10 by stakes, sandbags or other means known in the art.

Attached to the member 12 is a connector 16 with a source of a fluid 18. The member 12 conducts the fluid into the interior of the member 12 to inflate it. The connection may be a conduit on the outer periphery 20 as shown in FIG. 1, or it may be internal within the member 12. The fluid source 18 may be an air pump, canisters of compressed gas or a hose, or a similar source of a gas or liquid. In the preferred embodiment, the fluid is air from an air pump or fan. In one embodiment, a connection element for a fluid supply, such as a hose connection or a lock for an air conduit, may be attached to the element.

Figure 2:
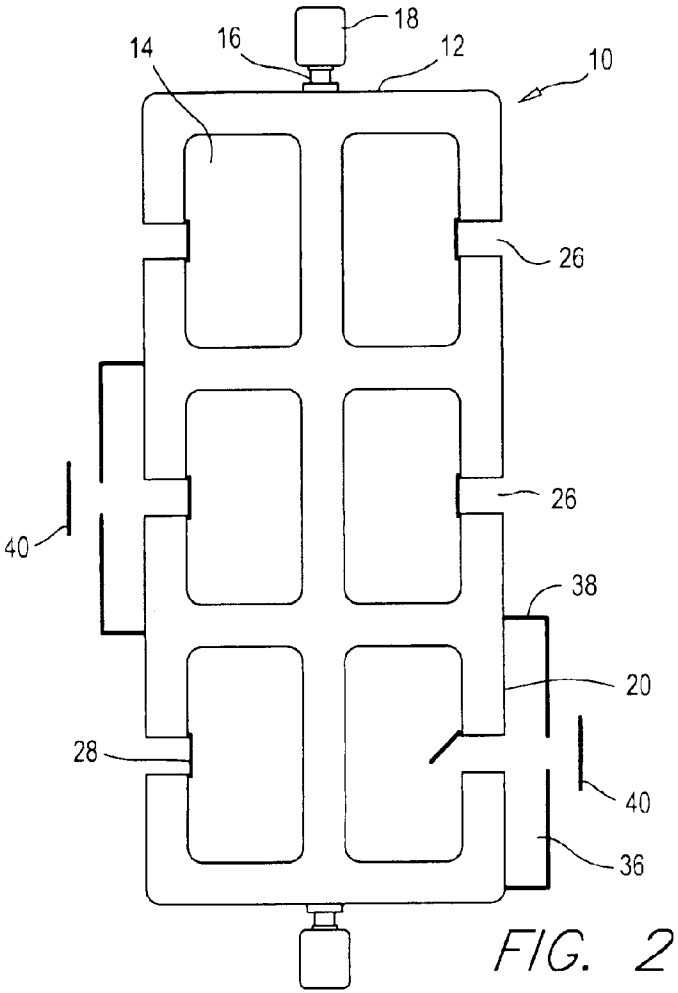
FIG. 2 shows a top plan view of an alternative embodiment of the invention.

If the member 12 is generally impermeable, then the source 18 can be disconnected from the member 12 after the member 12 is inflated, and the connection is then sealed. However, if the member 12 tends to deflate for a reason such as cold weather or leakage, the source 18 may remain connected to the barrier member 12 and continue inflation during use. Also, although two separate sources are shown in FIGS. 1 and 2, there may only need to be one source, or three or more sources may be needed, depending upon the desired inflation amount. It is also preferred, but not necessary, that the connector 16 and the source 18 are placed by the end elements 24 as shown, so they are as far from the openings 26 to the areas 14.

The barrier member 12 has at least one interior transverse element 22 and a plurality of end elements 24 for substantially encompassing at least one of the surrounded areas 14. As shown in FIGS. 1 and 2, the transverse element 22 can be T-shaped. However, other shapes such as crescents may be used depending upon the desired geometry of the enclosed area 14. Similarly, the end element 24 can be L-shaped as shown in FIGS. 1 and 2. As shown, in the preferred embodiment, two end elements 24 are placed end-to end. However, the end elements may be arcurate, F-shaped or have other geometry, depending upon the preferences of the manufacturer or the user, or the sport to be played. Also as shown, in the preferred embodiment, a central element runs through the middle of the embodiment, connecting the end elements and the transverse element. Other equivalent geometries may be preferred by the user. This barrier 10 may be used for regulation or smaller, junior size sports fields.

FIG. 1 shows the preferred embodiment of the barrier enclosing four fields. FIG. 2 shows the enclosure of six fields. However, more fields may be enclosed, so long as inflation can be made. Additionally, it is not necessary that the transverse elements 22 are used on both sides if the member 10. Thus, for example, three areas 14 may be enclosed: two areas 14 separated by a transverse element 22, and one area 14 encompassed by two end elements 24. Other configurations are also contemplated. Also, although a rectangular configuration is shown in FIGS. 1 and 2, the barrier element 12 may be oval, circular or some other shape as desired or necessary for the sport to be played in an area 14.

In an alternative embodiment, each of the elements has connectors for releasably joining a plurality of connected elements. For example, hook-and-loop fastener attachments may be used. Other types of connectors might be used, such as ties or snaps. These connectors can be used because they might impede inflation, but would not make inflation impossible with an appropriately powerful source 18.

In an alternative embodiment, a gate 28 is placed in front of the opening 26. The gate 28 may be across two transverse elements or across a transverse element and an end element, or both, as shown in FIG. 2. As detailed in FIG. 3, the gate 28 may be a substantially rigid material, such as a mesh 30 made of plastic. The gate 28 may be along the inner border of the area as shown in FIG. 2 or may be attached at the periphery of the elements forming the boundary of an enclosed area, depending upon the user's preference. The gate 28 preferably has at least one binge 32. The gate is also closable, preferable using tabs 34 located on the element opposite the hinge 32. However, other means for closing the gate are contemplated. Alternatively, a net blocks the opening 26, or the gate 28 is openable and closable by other means known in the art.

In another embodiment, shown in the bottom right corner of FIG. 2, located on the periphery 20 of the member 12 is at least one place 36 for holding players of a game on an enclosed area 14. Preferably, the area is delineated with an enclosing wall 38 of predetermined height enclosing the area 36. The wall 38 is preferably made of plastic, such as a mesh, and may be anchored to the ground surrounding the barrier 10 by stakes, sandbags or other means known in the art. It is preferred that hook-and-loop fastener, ties snaps or other similar means, releasably attaches the wall 38 to the outer perimeter of the barrier 10. The wall 38 may be attached to the outside of a transverse element 22, the outside of an end element 24, or both, as shown in FIG. 2. In another embodiment, a scoring table 40 is associated with one or more enclosed areas 36. The scoring table may be located behind the area as shown in FIG. 2, or it may be level with or in front of the enclosed area.

Figure 3:
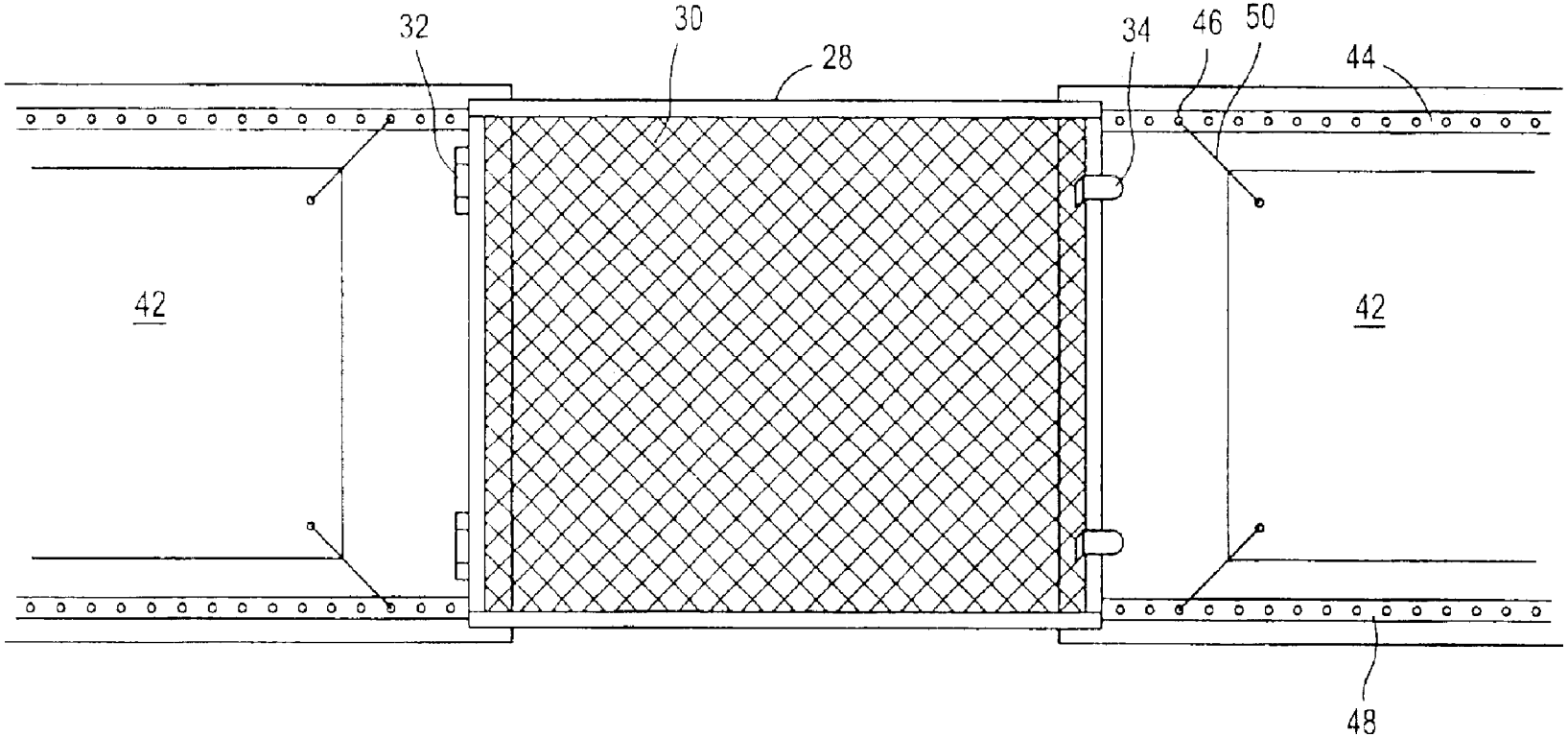
FIG. 3 shows a side view of a gate enclosing a demarked area of the invention.
Figure 5:
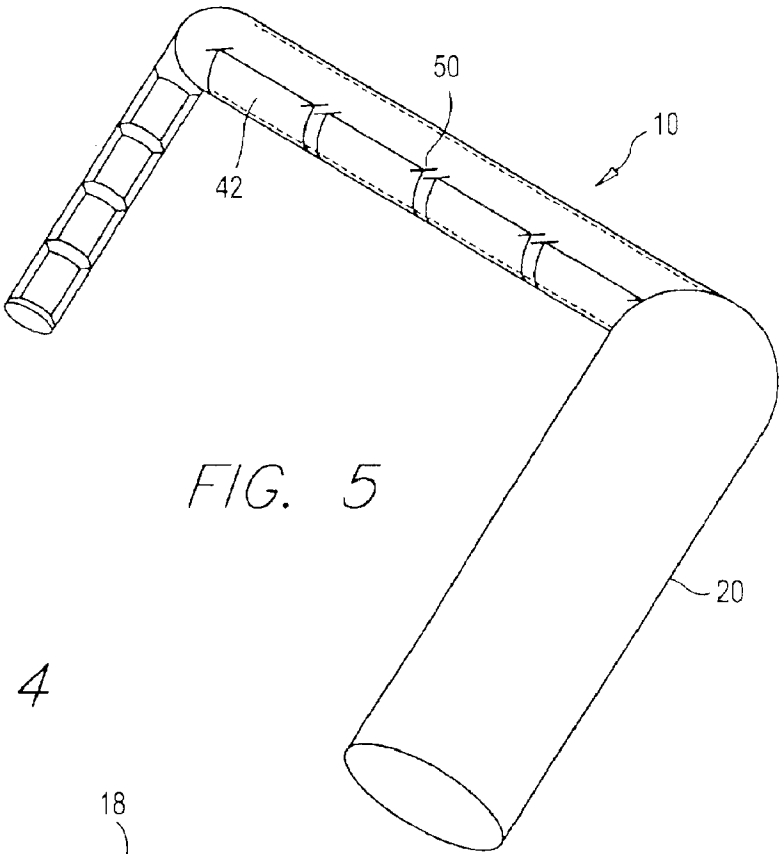
FIG. 5 shows a perspective view of a detail of an enclosed area of the invention having signage.
Figure 4:
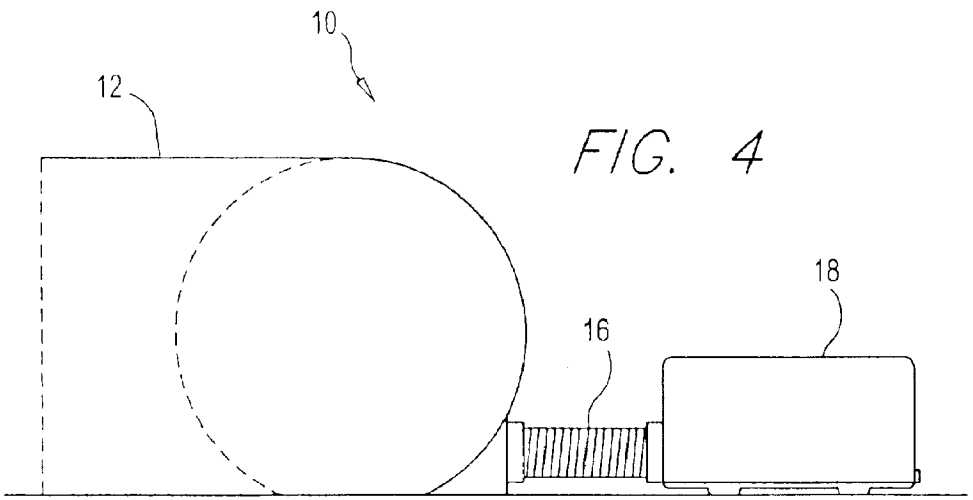
FIG. 4 shows a detail of a side view of an end element of the invention and a fluid source.
Figure 6:
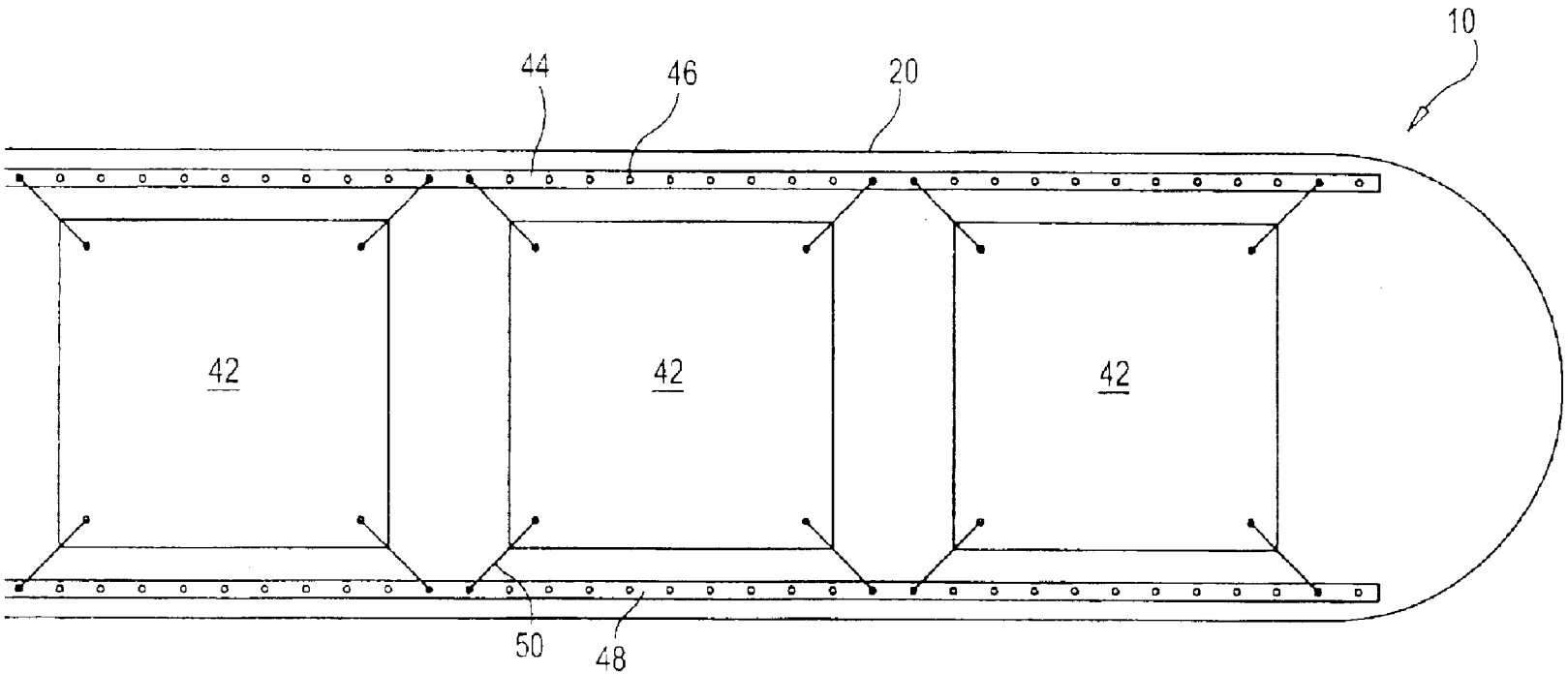
FIG. 6 shows a detail of a side view of the outer periphery of the invention having signage.

In yet another embodiment, illustrated in FIGS. 5 and 6, the inflatable barrier 10 includes means for attaching signage 42 on an outer surface of the barrier 10. As shown in FIGS. 3 and 5, the signage 42 can be facing an enclosed area 14, or, as shown is FIG. 6, the signage 42 may be on the outer periphery 20 of the element 12, or both. In the preferred embodiment, an upper strip 44 having perforations 46 is sewn, glued or otherwise appropriately attached to the outer surface of the element 12. In one embodiment, the strip is glued or sewn to the element as a relatively short flap. Furthermore, it is also preferred that a lower strip 48 is attached to the outer surface of the element in generally parallel orientation with the top strip 44, as shown in FIG. 6. Using ties 50, the signage 42 is tied to the element 12. The signage 42 may alternatively be attached to the elements by being enclosed in a clear plastic shield attached to the outer surface of the elements. The plastic shields may face inward toward the areas 14 or face outwards, or both. Alternatively, hook-and-loop fastener, an adhesive, or other similar means known in the art may be used to attach the signage 42 to the element 12.

In another embodiment, the inflatable element 12 may include goal areas located on the bottom section of the lower portion of the transverse elements 22. Similar goal areas may be placed on the bottom section of the far portion of one or more end elements 24. The shape of the goal areas may be rectangular, as for soccer, but may be of any appropriate shape for a particular sport. The goal areas are preferably netted to keep a ball from going into an adjacent field and to make the goal appropriate for a game. However, the netting is not required.

The method for using the inventive device is as follows. The inflatable barrier is laid out on a substantially level surface for inflation. The barrier member is then connected with a source of a fluid, such as air or water. The barrier is then inflated by the air or water. It may be preferred to have the barrier anchored in place. The anchoring may be done by stakes, sandbags, or other equivalent means known in the art.

Thus the present invention provides a lightweight, portable, inflatable apparatus for simultaneously substantially enclosing several areas for sport. The apparatus consists of flexible substantially air impervious boundary maker of sufficient size and shape to simultaneously demark a plurality of areas for sports, and means for connecting said boundary with an air source and for conducting said air into the interior of said boundary member to inflate it. In an alternative embodiment, the apparatus has walls for enclosing areas for holding players located on the outer perimeter of the boundary maker.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An inflatable barrier for simultaneously substantially enclosing several areas comprising:

an elongated, hollow barrier member formed of a plurality of connected elements of flexible substantially fluid impervious material joined to form a continuous configuration of sufficient size and shape to simultaneously demark several separated playing areas on a substantially flat surface;

connector means on each element of said elongate hollow barrier member for releasably joining said plurality of connected elements;

said barrier member including at least one interior transverse element and a plurality of end elements for substantially encompassing at least one of the separated playing areas;

means for gating at least one of the demarked areas, said means for gating including at least one of said separated areas;

means for connecting said hollow barrier member with a source of a fluid and for conducting said fluid into the interior of said hollow barrier member to inflate it;

said continuous configuration in the inflated condition supported on said substantially flat surface substantially defining a perimeter surrounding said areas; and said barrier member further comprising at least one means for holding players of a game on an enclosed field releasably attached to an outer perimeter of the barrier.

2. The inflatable barrier according to claim 1 in which each said element is formed of vinyl material.

3. The inflatable barrier of claim 1, wherein said transverse element is substantially T-shaped.

4. The inflatable barrier of claim 1, wherein said end element is substantially L-shaped.

5. The inflatable barrier of claim 1, wherein the said means for gating comprises a hinged gate comprised of a substantially rigid material.

6. The inflatable barrier of claim 1, wherein the at least one means for holding players of a game on a separately enclosed field releasably attached to an outer perimeter of the barrier is a low wall.

7. The inflatable barrier of claim 1, further comprising a scoring table located at an opening between said transverse element and said corner element.

8. The inflatable barrier of claim 1, wherein the barrier further comprises means for attaching signage on an outer surface of the barrier element.

9. The inflatable barrier of claim 1, wherein the means for connecting said hollow barrier member with a source of fluid and for conducting fluid into the interior of said hollow barrier member to inflate it includes a connection element for an air supply.

10. The inflatable barrier of claim 1, wherein the means for connecting said hollow barrier member with a source of fluid and for conducting fluid into the interior of said hollow barrier member to inflate it includes a hose connector.

11. The inflatable barrier of claim 1, further comprising goal areas for a separated field located on the lower portion of the transverse elements.

12. The inflatable barrier of claim 1, further comprising goal areas for a separated field located on the lower portion of the end elements.

13. The inflatable barrier of claim 11, wherein the goal areas include netting.

* * * * *